United States Patent [19]

Thurston

[11] Patent Number: 5,003,912

[45] Date of Patent: Apr. 2, 1991

[54] INTERLOCKING STACKING PLASTIC BARRICADES

[76] Inventor: Kurt W. Thurston, P.O. Box 1887, Reno, Nev. 89505

[21] Appl. No.: 383,298

[22] Filed: Jul. 20, 1989

Related U.S. Application Data

[63] Continuation-in-part of Ser. No. 183,382, Apr. 13, 1988, abandoned, which is a continuation of Ser. No. 25,604, Mar. 13, 1987, abandoned.

[51] Int. Cl.[5] ..... E01F 13/00

[52] U.S. Cl. ..... 116/63 P; 40/610; 256/64

[58] Field of Search ..... 116/63 P, 63 A, 63 R; 256/64, 65, 66; 404/6, 9, 10; 40/612, 610, 606, 903; 403/381; 446/120, 125; 340/908, 908.1

[56] References Cited

U.S. PATENT DOCUMENTS

| | | | |
|---|---|---|---|
| 2,649,803 | 8/1953 | Andre | 446/120 |
| 3,822,668 | 7/1974 | Schradieck et al. | 40/903 |
| 3,916,816 | 11/1975 | Fitch | 116/63 P |
| 3,949,701 | 4/1976 | Teixeira | 116/63 P |
| 4,007,919 | 2/1977 | Totten | 256/65 |
| 4,026,086 | 5/1977 | Langley | 446/125 |
| 4,083,033 | 4/1978 | Kulp et al. | 116/63 P |
| 4,298,186 | 11/1981 | Glass | 256/64 |
| 4,624,210 | 11/1986 | Glass | 116/63 P |

*Primary Examiner*—William A. Cuchlinski, Jr.
*Assistant Examiner*—W. Morris Worth
*Attorney, Agent, or Firm*—Flehr, Hohbach, Test, Albritton & Herbert

[57] ABSTRACT

An interlocking stackable, plastic barricade includes two identical integrally molded plastic panels which are hinged to pivot around a common axis. Each panel includes at the left and right edges a pair of interlocking elements—one being a protrusion at one edge and the other an indentation at the other. When the barricades are stacked, this pair of interlocking elements mate together to form a stable stack.

5 Claims, 2 Drawing Sheets

INTERLOCKING STACKING PLASTIC BARRICADES

This is a continuation-in-part, of application Ser. No. 183,382 filed Apr. 13, 1988 now abandoned, which is a continuation of application Ser. No. 025,604 filed 3/13/87 now abandoned.

FIELD OF THE INVENTION

The present invention is directed to an interlocking, stackable barricade whichy is useful as a traffic barricade.

BACKGROUND OF THE INVENTION

Barricades of molded plastic have been known for some time. They typically include two panel units hinged together so that they can be spread apart for use and folded and collapsed for storage or transport. The individual panel units are one piece, integral, hollow plastic panels, formed by rotational or blow molding. The hollow plastic panels may be filled with sand as ballast to make them withstand wind forces. Examples of plastic barricades of the type described above are illustrated in Glass U.S. Pat. Nos. 4,298,186 and 4,624,210.

Since the plastic barricades are by nature smooth and slippery and have substantially planar outside faces, if they are stacked together (for example, for storage) the stability of a number of stacked units is less than desired at times.

OBJESTS AND SUMMARY OF THE INVENTION

Thus, it is a general object of the present invention to provide an improved plastic stackable barricade.

It is another object of the invention to provide a stackable barricade as shown where the user of the barricade may easily stack the with the barricades automatically interlocking with each other without any thought on the part of the user.

In accordance with the above objects, there is provided an interlocking, stackable barricade constructed from two substantially similar generally planar panel units hinged together to pivot around a common axis of rotation, each of said panel units having left and right edges when an outside face of said hinged barricade is directly viewed by an observer, each of said panel units being one piece, hollow, integrally molded plastic. The invention is characterized by each of the panel units including at least one pair of interlocking means located on the outside face of each of the panel units proximate to the left and right edges. One of the pair of inter-locking means is an indentation in and the other a protrusion from the outside face. The indentation and protrusion are dimensioned and shaped to closely mate together. The protrusion for each of the two panel units of the left and right edges, whereby assuming the same lengthwise orientation of a barricade, one folded barricade may be stacked on another with the interlocking means automatically mating.

DESCRIPTION OF THE PREFERRED EMBODIMENTS

Figure 1:
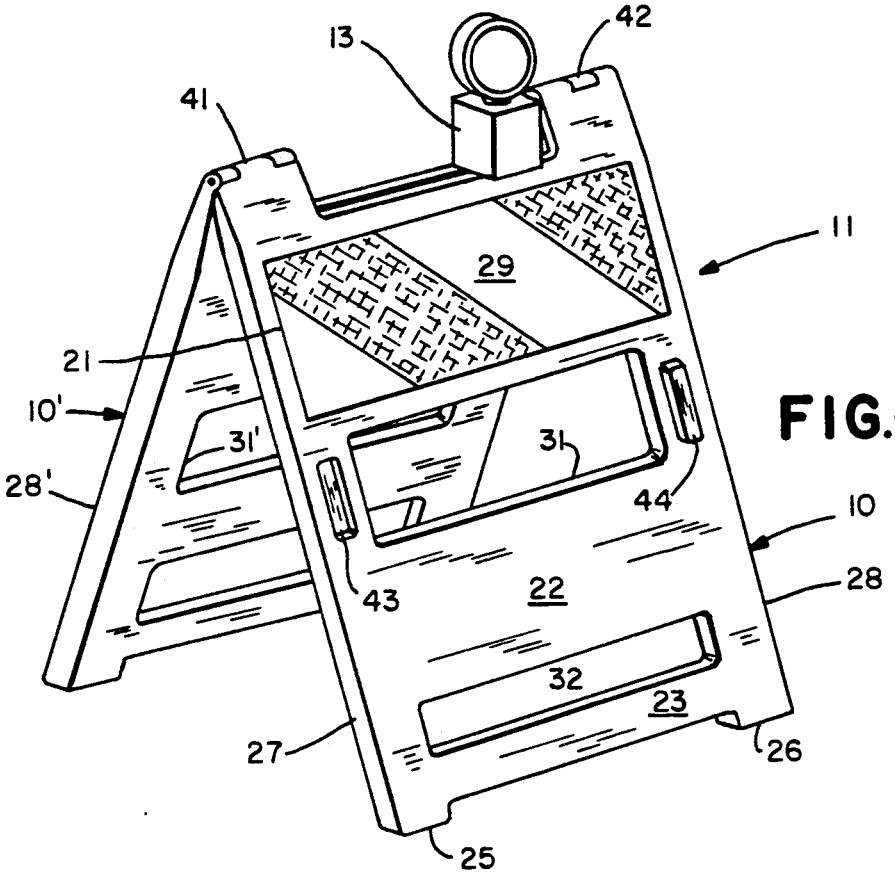
FIG. 1 is a perspective view of the barricade embodying the present invention.
Figure 2:
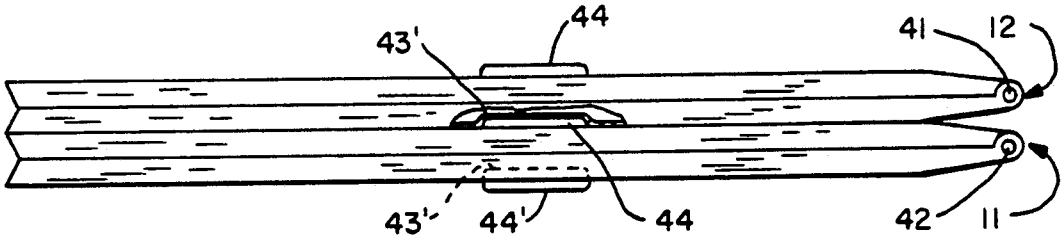
FIG. 2 is a side view partially cut away of two stacked barricades embodying the present invention.
Figure 3:
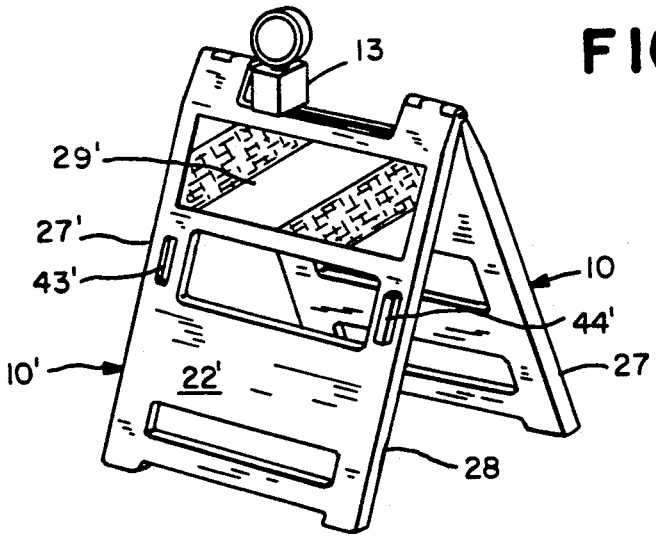
FIG. 3 is a perspective view of the barricade of FIG. 1 looking at the barricade from the opposite direction, as shown in FIG. 1.

The foldable barricade 11 illustrated in FIG. 1 consists of a pair of identical, integral, hollow plastic panel units 10 and 10'. In the specific embodiment each panel unit is formed by blow molding and moreover is formed with the use of a common die (since the panels are identical). FIG. 1 illustrates the barricade with the panel units spread apart and the unit generally positioned vertically so that it can function as a traffic barricade. FIG. 2, as will be discussed in greater detail below, illustrates the panel unit 11 folded, with a second barricade 12 stacked on top of it in an interlocking manner. Finally, FIG. 3 shows the other side of the barricade of FIG. 1 which is identical except that the flasher light 13 is located on the opposite side.

In general, in describing the two panel units the same prime system will be utilized as with panel units 10 and 10'. Referring to both FIGS. 1 and 3, each panel unit is constructed with three horizontal panel members 21, 22 and 23, and two vertical leg members 25 and 26; leg member 25 forms a left edge 27 of the panel 10 and leg 26 forms a right edge 28. Panel member 21 and 22 are referred to as "strip bars" since—at least in the case of panel member 21—it includes a recessed portion where a strip of relective material 29 may be placed. The same can be true of panel member 22, for which nothing is indicated, however. Strip 29 extends almost to the edges 27, 28.

Each panel unit also includes adjacent to panel members 21, 22 and 23, an intermediate cut out portion 31 and a lower cut out portion 32. These are for the purpose of reducing wind resistance and also material usage in the manufacture of the panels. The recessing of reflective stripe 29 prevents any abrasion of the reflected material when the units are stacked together and also provides that the outside face (which of course includes the panel members 21, 22 and 23) of the panel unit is substantially planar to allow for easy stackability.

The tops of the panel units 10 and 10' are hinged together by hinge members generally indicated at 41 and 42. For panel unit 10 the hinge member 41 is the opposite of the hinge member 42 in configuration. This, as discussed above, allows a single blow mold die to be utilized to form identical panels 10 and 10'. Details of the hinges are shown in the above Glass U.S. No. '210 patent. As discussed in that patent, the hinge may include a detent which provides for locking the barricade in an open position.

In order to provide for interlocking, stackable barricades, as illustrated in FIG. 2 with barricades 11 and 12, there is provided on each panel unit, for example, panel unit 10, a pair of interlocking means located on the outside face of the panel. Specifically, these are a recess or identation 43, located near left edge 27 and a protrusion 44 located near the right edge 28. Protrustion 44 is in the form of an elongated bar which may have typical dimensions of 3" in length, $\frac{3}{4}$" width and with a height from the face of the panel 10 of $\frac{3}{4}$". Thus, the indentation of female unit 43 of the interlocking pair would have slightly larger dimensions in order to provice a good mate of the male unit 44 with the female unit 43. This mating is illustrated in FIG. 2 where the protrusion 44 mates with the indentation 43 on another barricade 12 to allow the panel units to abut each other as clearly shown.

Referring to FIG. 3, which shows the opposite side of the barricade of FIG. 1, there is an identical protrusion 44' and indentation 43' on panel unit 10'. And of course, the indentation 43' is proximate to the left edge 27' since it is the left edge as defined by a viewer looking directly at the outside face of the barricade, as illustrated in FIG. 3. This conforms to the requirement that both blow molded panels are identical.

Also, by the above orientation of the interlocking means with the raised portion always being at a predetermined edge, for example, the right edge when the panel is viewed by an observer directly, this means that when the user of the barricade is stacking one barricade on top of another, as long as the barricade is oriented in this same lengthwise orientation, that is, with the tops or the hinges in the same orientation, the barricades will automatically interlock without any further thought on the user's part. In other words, the male portion 44 will always inherently be located above the proper female portion 43 of the next barricade.

As illustrated in FIG. 2, also, there are side views of the other interlocking means associated with the barricade. And in the case of barricade 11, the protrusion 44' is of course located on the opposite leg.

It has been found that the most effective interlocking means is a single pair of units 43 and 44 located adjacent to the intermediate cut out portion 31. Additional pairs of interlocking means could be provided if desired. But with the location as illustrated adjacent the intermediate cut out 31, this location does not interfere with the reflective striping at 29, which extends towards the left and right edge of 27 and 28 to substantially the same extent as the interlocking means 43 and 44.

Finally, of course, the light 13 would necessarily be removed before the barricade as stacked.

With the rectangularly shaped indentation and protrusion 43 and 44, as illustrated in FIG. 1 through 3, only a single pair of interlocking devices is necessary. This is because of their rectangular shape and the long axis of such rectangular members being parallel to the left and right edges 27 and 28 of each of the panel units. Such configuration effectively resists either sliding forces or torsional forces tending to rotate or move one interlocked barricade on top of the other. In other words, due to the elongated nature of the rectangular protrusion and indentation there is sufficient wall area to resist especially torsional forces.

Figure 4:
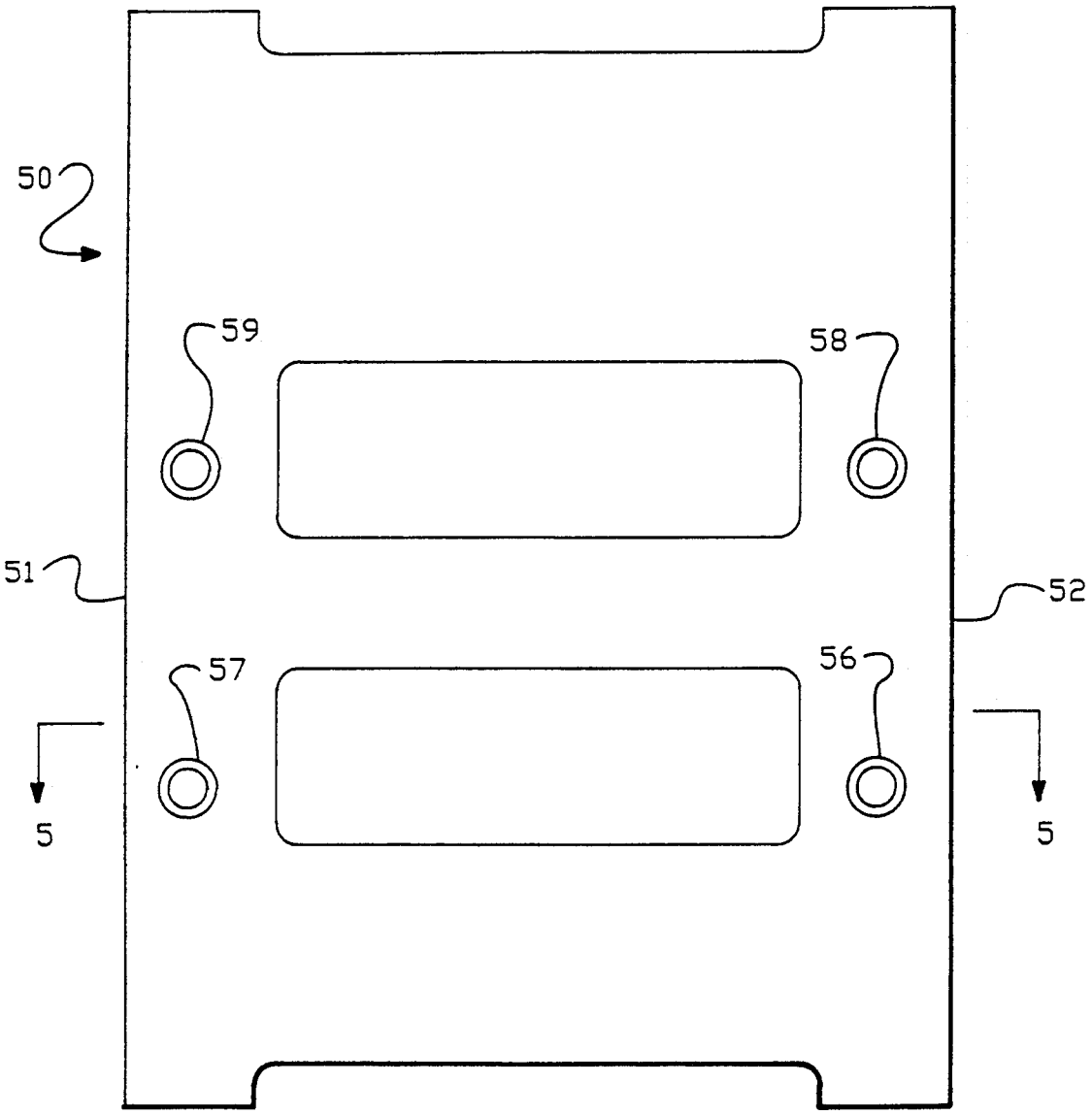
FIG. 4 is an elevation view of an alternative embodiment of the invention.
Figure 5:
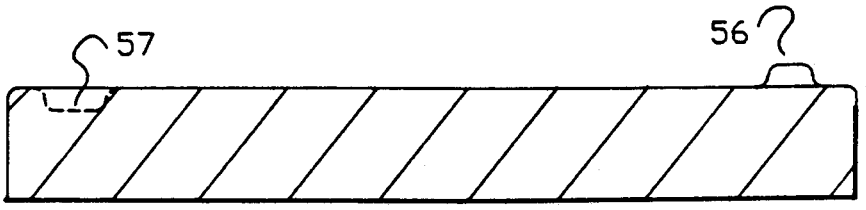
FIG. 5 is a simplified cross-sectional view taken substantially along the line 5—5 of FIG. 4.

Rather than a rectangular configuration, substantially circular protrusions and indentations may be utilized, as shown in FIGS. 4 and 5. Here, opposite the cutout 54 is one pair of interlocking means, including a circular protrusion 56 and its mating indentation 57. A typical dimension might be 1.25" for protrusion 56 and 1.312" for indentation 57. Because the wall area is somewhat less when compared to a rectangular configuration, as in the previous embodiment, it is useful to place opposite the cutout 53 a second spaced pair of interlocking means; namely, protrusion 58 and indentation 59. This spacing effectively provides resistance to torsional forces tending to rotate one barricade with respect to an adjacent stacked barricade. Although the configurations have been shown as circular, an equivalent type of configuration such as a rounded off square could also be used.

Thus, an improved, interlocking stackable plastic barricade has been provided.

What is claimed:

1. An interlocking, stackable plastic barricade constructed from two substantially similar generally planar panel units hinged together to pivot around a common axis of rotation, each of said panel units having left and right edges when an outside face of said hinged barricade is directly viewed by an observer, each of said panel units being one piece, hollow, integrally molded plastic, the invention being characterized by each of said panel units including at least one pair of interlocking means located on said outside face of each of said panel units proximate to said left and right edges of said panel unit, one of said pair of interlocking means being rectangular shaped indentation in and the other a rectangular shaped protrusion from said outside face, said indentation and protrusion being dimensioned and shaped to closely mate together but to be freely separable, said protrusion for each of siad two panel units of said barricade always being located on a predetermined one of said left and right edges, whereby assuming the same lengthwise orientation of a barricade, one folded barricade may be stacked on another, with the interlocking means of said one barricade automatically mating with the interlocking means of an adjacent barricade and facing planar panel units of both barricades abutting each other, and each of said panel units being manufactured by a plastic molding process using an identical die for each panel unit, said die providing for formation of both the overall panel unit and said interlocking means.

2. A barricade as in claim 1 wherein each panel unit of said barricade includes an intermediate cut out portion and said interlocking means are located adjacent to said cut out portion.

3. An interlocking barricade as in claim 1 where there is only one pair of said interlocking means on each panel unit and where said rectangular shaped indentation and protrusion each have a long axis parallel to said left and right edges.

4. An interlocking, stackable plastic barricade constructed from two substantially similar generally planar panel units hinged together to pivot around a common axis of rotation, each of said panel units having left and right edges when an outside face of said hinged barricade is directly viewed by an observer, each of said panel units being one piece, hollow, integrally molded plastic, the invention being characterized by each of said panel units including at least one pair of interlocking means located on said outside face of each of said panel units proximate to said left and right edges of said panel unit, one of said pair of interlocking means being an indentation in and the other a protrusion from said outside face, said indentation and protrusion being dimensioned and shaped to closely mate together but to be freely separable, said protrusion for each of said two panel units of said barricade always being located on a predetermined one of said left and right edges, whereby assuming the same lengthwise orientation of a barricade, one folded barricade may be stacked on another, with the interlocking means of said barricade automatically mating with the interlocking means of an adjacent barricade and facing planar panel units of both barricades abutting each other, and each of said panel units being manufactured by a plastic molding process using an identical die for each panel unit, said die providing for formation of both the overall panel unit and said interlocking means.

5. An interlocking barricade as in claim 4 where said indentation and protrusion are substantially circularly shaped and including at least two said pairs on each panel unit spaced from each other along said left and right edges for providing resistance to torsional forces tending to rotate said one barricade with respect to said adjacent stacked barricade.

* * * * *